US011055985B2

(12) United States Patent
Greene

(10) Patent No.: US 11,055,985 B2
(45) Date of Patent: Jul. 6, 2021

(54) SYSTEMS AND METHODS FOR PROVIDING REMOTE-CONTROL SPECIAL MODES

(71) Applicant: DISH TECHNOLOGIES L.L.C., Englewood, CO (US)

(72) Inventor: Gregory H. Greene, Littleton, CO (US)

(73) Assignee: DISH TECHNOLOGIES L.L.C., Englewood, CO (US)

( * ) Notice: Subject to any disclaimer, the term of this patent is extended or adjusted under 35 U.S.C. 154(b) by 624 days.

(21) Appl. No.: 15/291,702

(22) Filed: Oct. 12, 2016

(65) Prior Publication Data

US 2018/0102048 A1 Apr. 12, 2018

(51) Int. Cl.
*G08C 17/02* (2006.01)

(52) U.S. Cl.
CPC ..... *G08C 17/02* (2013.01); *G08C 2201/90* (2013.01)

(58) Field of Classification Search
CPC ..... G08C 17/02; G08C 2201/90; G08C 2201/91; G08C 2201/92; G08C 2201/93
See application file for complete search history.

(56) References Cited

U.S. PATENT DOCUMENTS

| | | | | |
|---|---|---|---|---|
| 6,750,802 | B1 * | 6/2004 | Olen | G08C 23/04 340/12.22 |
| 2001/0003542 | A1 * | 6/2001 | Kita | H04R 1/1041 381/334 |
| 2005/0114885 | A1 * | 5/2005 | Shikata | H04H 40/18 725/38 |
| 2005/0144637 | A1 * | 6/2005 | Shikata | H04N 21/466 725/35 |
| 2013/0027194 | A1 * | 1/2013 | Weng | H04N 21/42208 340/12.54 |
| 2016/0146492 | A1 * | 5/2016 | Tomomatsu | F24F 11/62 700/276 |

* cited by examiner

*Primary Examiner* — Thomas D Alunkal
(74) *Attorney, Agent, or Firm* — Seed IP Law Group LLP

(57) ABSTRACT

A receiving device may assign a remote-control device of the receiving device to a special mode by storing an association of an identifier unique to the remote-control device with the particular special mode. The receiving device may receive a command from the remote-control device and determine that there has been a special mode assigned to the remote-control device based on the stored association of the identifier unique to the remote-control device with the particular special mode. The receiving device will then interpret the command received from the remote-control device according to how commands are to be processed in the special mode. The receiving device having the remote-control device assigned to the special mode may cause the receiving device to execute a different command or process than it would have normally performed when receiving such a command from a remote-control device that is not assigned to the special mode.

27 Claims, 8 Drawing Sheets

400a

| Special Mode (402a) | Received Command 1 (402b) | Received Command 2 (402c) | Received Command 3 (402d) |
|---|---|---|---|
| Music Mode (404a) | perform process x | perform process y | perform process h |
| Limited Use Mode A (404b) | ignore | perform process k | execute |
| Limited Use Mode B (404c) | execute | execute | ignore |
| Limited Use Mode C (404d) | ignore | ignore | ignore |

Fig. 4A

400b

| Remote-control Identifier (406a) | Current Special Mode (406b) |
|---|---|
| 123 (408a) | Music Mode |
| 124 (408b) | Limited Use Mode B |
| 125 (408c) | Limited Use Mode A |

Fig. 4B

SYSTEMS AND METHODS FOR PROVIDING REMOTE-CONTROL SPECIAL MODES

TECHNICAL FIELD

The technical field relates to remote-control operations, and more particularly, to providing remote-control special modes.

BRIEF SUMMARY

Home entertainment systems often have music channels provided by cable or satellite television service providers or streaming music services. Getting to and changing between these music channels often involves selecting such channels on an electronic program guide (EPG) displayed on a television connected to the receiving device such as the cable or satellite set-top box. However, if one would like to listen to such music channels in a different room than the television is in, it is inconvenient to have to go back to the television to take the set-top box out of standby mode and select such channels using the EPG displayed on the television.

To alleviate the above problem, described herein is a receiving device that, in response to a user command, assigns a remote-control device of the receiving device to a special mode by storing an association of an identifier unique to the remote-control device with the particular special mode. The special mode to which remote-control 128 is assigned may be a special music mode. Then in response to receiving a command from the remote-control device to change to a next channel, either up or down depending on the received command, the receiving device first takes the receiving device out of standby mode if it is currently in standby mode and then jumps to the first channel in a list of music service channels instead of to the next channel numerically, which may be a television channel. If the next channel is in fact a music service channel, then the receiving device will change to this next music service channel while the remote-control device is assigned to the special music mode. In this manner, the user may have a particular remote-control device of the set-top box that is assigned to this special music mode and use this remote-control device to easily listen to and change between music channels, for example on a wireless speaker, in a different room than the television is in. The user may have other remote-control devices of the set-top box on the customer premises that are not assigned to this special music mode that can, thus, be used to normally control the set-top box watch television.

As another example, the set-top box may receive a command from remote-control device and determine that there has been a special limited use mode assigned to the remote-control device based on the stored association of the identifier unique to the remote-control device with the particular limited use mode. The receiving device will then interpret the command received from the remote-control device according to how commands are to be processed in the special limited use mode. The receiving device having the remote-control device assigned to the special limited use mode may cause the set-top box to ignore certain commands received from the remote-control device or execute a different command or process than it would have normally performed when receiving such a command from a remote-control device that is not assigned to the limited use mode. This may be useful in cases where the user desires to limit what functions the remote-control device can cause the receiving device to perform to preserve settings or prevent certain channels from being viewed, such as when the remote-control device is being used by children or other users.

BRIEF DESCRIPTION OF THE SEVERAL VIEWS OF THE DRAWINGS

The components in the drawings are not necessarily to scale relative to each other. Like reference numerals designate corresponding parts throughout the several views.

FIG. 4A is a table illustrating an example of how commands received from a remote-control device by a receiving device may be interpreted by the receiving device according to remote-control special modes, according to one example embodiment.

FIG. 4B is a table illustrating an example of how particular remote-control devices may be assigned by a receiving device to particular special modes, according to one example embodiment.

DETAILED DESCRIPTION

Figure 1:
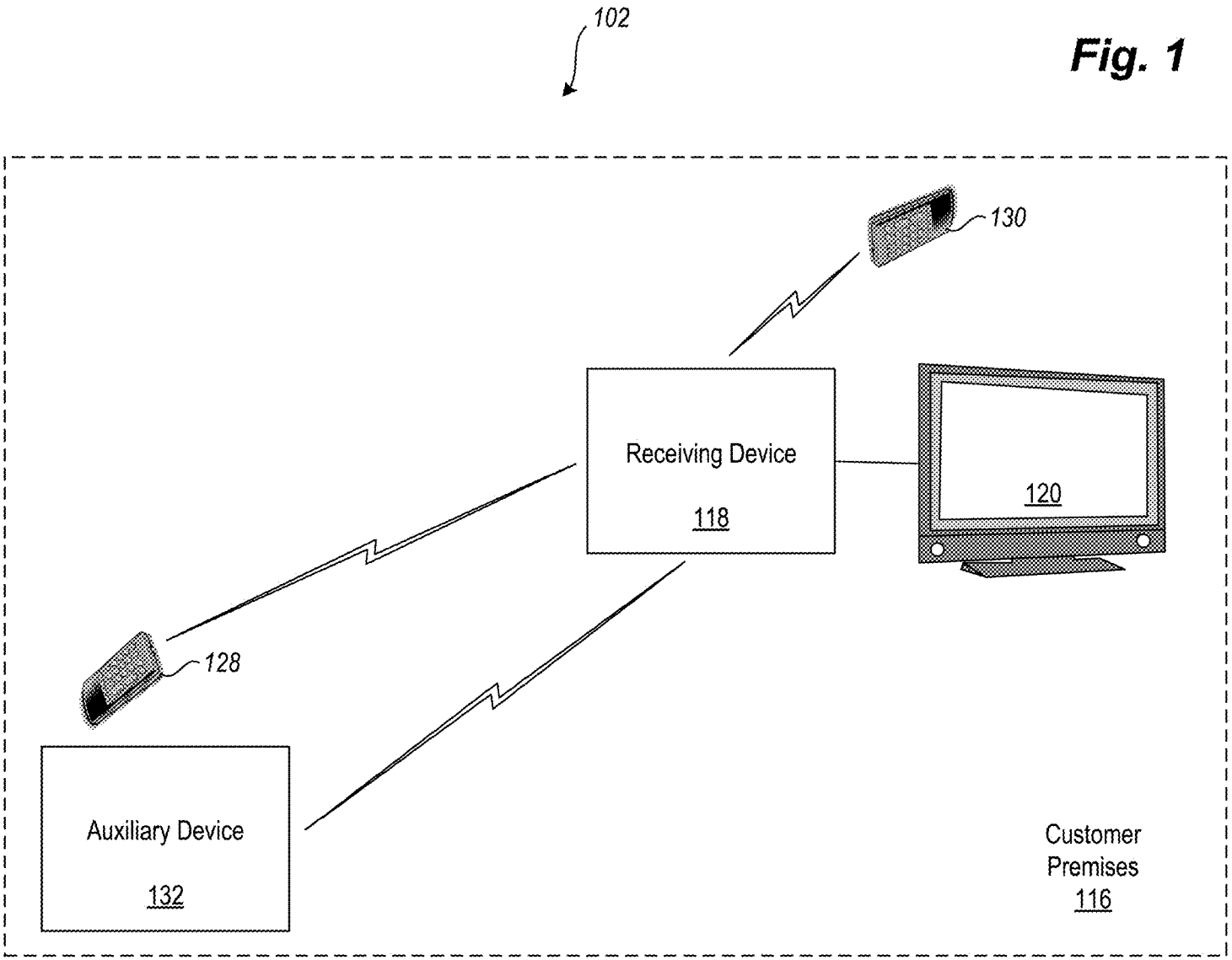
FIG. 1 is a block diagram illustrating an example environment in which embodiments of providing remote-control special modes may be implemented, according to one example embodiment.

FIG. 1 is a block diagram illustrating an example environment 102 in which embodiments of providing remote-control special modes may be implemented, according to one example embodiment. Shown in FIG. 1 is a receiving device 118 in operable communication with a presentation device 120, an example auxiliary device 132, and two example remote-control devices of the receiving device, which are remote-control device 128 and remote-control device 130. In response to a user command to do so, the receiving device 118 may assign a remote-control device of the receiving device, such as remote-control device 128, to a special mode. In some embodiments, the receiving device 118 may assign remote-control device 128 to a special mode by storing an association of an identifier unique to the remote-control device 128 with the particular special mode to which the remote-control device 128 is being assigned. This unique identifier of the remote-control device 128 is received with each command that is received by the receiving device 118 from a remote-control device, such as remote-control device 128 or remote-control device 130. When the receiving device 118 receives a command from a remote-control device, such as from remote-control device 128 or remote-control device 130, the receiving device will read the unique identifier received with the command and determine whether there has been a special mode assigned to the remote-control device having that unique identifier.

For example, the receiving device 118 may receive a command from remote-control device 128 and determine that there has been a special mode assigned to the remote-control device 128 based on the stored association of the identifier unique to the remote-control device 128 with the particular special mode. The receiving device 118 will then interpret the command received from the remote-control device 128 according to how commands are to be processed in the special mode. The receiving device 118 having the remote-control device assigned to the special mode may cause the receiving device 118 to execute a different command or process than it would have normally performed when receiving such a command from a remote-control device that is not assigned to the special mode. This may be useful in cases where the user is using the remote-control device to perform operations while not watching television or otherwise out of view from the presentation device 120. For example, if the auxiliary device 132 is a wireless speaker being used by the receiving device 118, but located in a different room from that of the receiving device 118, such as to listen to music service channels, the special mode to which remote-control 128 is assigned may be a special music mode. Then in response to receiving a command from the remote-control device 128 to change to a next channel, the receiving device 118 may instead first take the receiving device 118 out of standby mode if it is currently in standby mode and then jump to the first channel in a list of music service channels instead of to the next channel numerically, which may be a television channel. If the next channel is in fact a music service channel, then the receiving device 118 will change to this next music service channel while the remote-control device 128 is assigned to the special music mode.

As another example, the receiving device 118 may receive a command from remote-control device 128 and determine that there has been a special limited use mode assigned to the remote-control device 128 based on the stored association of the identifier unique to the remote-control device 128 with the particular limited use mode. The receiving device 118 will then interpret the command received from the remote-control device 128 according to how commands are to be processed in the special limited use mode. The receiving device 118 having the remote-control device assigned to the special limited use mode may cause the receiving device 118 to ignore certain commands received from the remote-control device or execute a different command or process than it would have normally performed when receiving such a command from a remote-control device that is not assigned to the limited use mode. This may be useful in cases where the user desires to limit what functions the remote-control device can cause the receiving device 118 to perform to preserve settings or prevent certain channels from being viewed, such as when the remote-control device 128 is being used by children or other users.

For example, a parent may provide a child a specific remote-control device 128 to use that has been assigned to a special limited use mode, such that only those channels that are in the child's favorites list may be tuned to by the receiving device 118 when a channel change command is received from that particular remote-control device 128. In response to receiving a command from the remote-control device 128 to change a channel, the receiving device 118 may jump to the first channel the child's favorites list instead of to the next channel numerically, which may be a television channel not in the child's favorites list. If the next channel is in fact a channel in the child's favorites list, then the receiving device 118 will change to this next channel while the remote-control device 128 is assigned to this special limited use mode.

As another example, when the remote-control device 128 is assigned to a particular limited use mode, when the receiving device 118 receives a command that is included in a restricted list of commands associated with the particular limited use mode, the receiving device 118 will ignore the command. Such commands, for example, may be those to change settings or configurations of the system, view a menu, or to record or play content or other commands. The commands to include in the list of commands that are to be restricted may be selectable by the user.

Before providing additional details regarding the operation and constitution of systems and methods for providing remote-control special modes, the example environment 102, within which such a system may operate, will briefly be described.

In the environment 102, audio, video, and/or data service providers, such as television or streaming media service providers, provide their customers a multitude of video and/or data programming (hereafter, "programming content"). Such programming content is often provided by use of a receiving device 118 communicatively coupled to a presentation device 120 configured to receive the programming. The programming may include any type of media content, including, but not limited to: television shows, news, movies, sporting events, advertisements, other video or audio, etc. Programming content may be communicated to the receiving device 118 through suitable communication system (not shown). Such a communication system may include many different types of communication media, now known or later developed. Non-limiting media examples include satellite, telephone systems, the Internet, internets, intranets, cable systems, cellular systems, fiber optic systems, microwave systems, asynchronous transfer mode ("ATM") systems, packet-switched systems, frame relay systems, digital subscriber line ("DSL") systems and radio frequency ("RF") systems. In at least one embodiment, the received programming content may include or represent video data and/or audio data. Various embodiments of the receiving device 118 may receive programming directly from a content server, a content provider, alternate video source server, and/or another information server via satellite, locally broadcast RF signals, cable, fiber optic, Internet media, or the like.

The receiving device 118 is a conversion device that converts, also referred to as formatting, the received signal into a signal suitable for communication to a presentation device 120 and/or an auxiliary device 132. The received signal communicated to the receiving device 118 may be a relatively weak signal that is amplified, and processed or formatted, by the receiving device 118. The amplified and processed signal is then communicated from the receiving device 118 to the presentation device 120, such as a television ("TV") or the like, and/or to an auxiliary device 132 in a suitable format. It is to be appreciated that presentation device 120 may be any suitable device operable to present a program having video information and/or audio information.

The receiving device 118 connects to one or more communications media or source devices (such as a cable head-end, satellite antenna, telephone company switch, Ethernet portal, off-air antenna, content server, or the like) that provide the programming content. The receiving device 118 commonly receives a plurality of programming content by way of the communications media or source devices. Based upon selection by a user, the receiving device 118 processes and communicates the selected programming to the presentation device 120. Further, the receiving device 118 may itself include user interface devices, such as buttons, switches and displays.

For convenience, examples of a receiving device 118 may include, but are not limited to, devices such as: a receiver, a television converter, a set-top box, television receiving device, television receiver, television recording device, satellite set-top box, satellite receiver, cable set-top box, cable receiver, media player, a digital video recorder (DVR), smartphone, mobile device, tablet device, a personal computer (PC), and/or television tuner. Accordingly, the receiving device 118 may be any suitable converter device or electronic equipment that is operable to receive or play back programming content. Further, the receiving device 118 may itself include user interface devices, such as buttons or switches. In many applications, a remote-control device ("remote") 128 is operable to control the receiving device 118 and/or the presentation device 120. The remote 128 typically communicates with the receiving device 118 using a suitable wireless medium, such as infrared ("IR"), radio frequency ("RF"), or the like.

An interface between the receiving device 118 and a user may be provided by one or more hand-held remote-control devices such as remote-control device 128 and remote-control device 130. For example, remote-control device 128 typically communicates with the receiving device 118 using a suitable wireless medium, such as infrared ("IR"), radio frequency ("RF"), or the like and may be any wireless handheld device, including a mobile device such as a cellular telephone or a tablet device. Various remote-control device communication protocols and platforms may be used including those that communicate a unique identifier of the remote-control device from which the command is received. Non-limiting examples include a remote-control device that operates on an RF Zigbee network based on the IEEE 802.15.4 specification or a remote-control device that uses RF remote-control protocols that operate according to the Radio Frequency for Consumer Electronics (RF4CE) specification. Other input or control devices (not shown) may also be communicatively coupled to the receiving device 118. Non-limiting examples include game device controllers, keyboards, touch pads, touch screens, pointing devices and the like.

Although shown in FIG. 1 as a wireless device, auxiliary device 132 may be any suitable device that is operable to receive an audio or video signal or other media data from the receiving device 118 via a wired or wireless connection to the receiving device 118. Non-limiting examples of an auxiliary device 132 include wired or wireless speakers, optical media recorders, such as a digital versatile disc or digital video disc ("DVD") recorder, a digital video recorder ("DVR"), a personal video recorder ("PVR"), an amplifier, a radio, a tape player, a turntable, receiver, a media device, or a streaming media device. Auxiliary device 132 may also include game devices, magnetic tape type recorders, RF transceivers, personal computers ("PCs"), and personal mobile computing devices such as cell phones, mobile devices, tablets or personal digital assistants (PDAs). A customer premises 116 may have fewer or more auxiliary devices than shown in FIG. 1 that are each in operable communication with the receiving device 118.

Non-limiting examples of network or communication systems that may provide operable communication between the receiving device 118 an auxiliary device 132 in various embodiments include, but are not limited to, short range wireless network (e.g., Bluetooth®) system, a wireless local area network (LAN) system, a WiFi system, an Ethernet system, twisted pair Ethernet system, an intranet, a local area network ("LAN") system, a personal area network (e.g., a Zigbee network based on the IEEE 802.15.4 specification) and a Consumer Electronics Control (CEC) communication system.

Examples of a presentation device 120 may include, but are not limited to: a television (TV), a personal computer (PC), a television or computer monitor, sound system receiver, smartphone, mobile device, tablet device, game system, or the like. A presentation device 120 may employ a display, one or more speakers, and/or other output devices to communicate video and/or audio content to a user. In many implementations, one or more presentation devices 120 reside in or near a customer's premises 116 and are communicatively coupled, directly or indirectly, to the receiving device 118. Further, the receiving device 118 and the presentation device 120 may be integrated into a single device. Such a single device may have the above-described functionality of the receiving device 118 and the presentation device 120, or may even have additional functionality.

The above description of the environment 102, the customer premises 116, and the various devices therein, is intended as a broad, non-limiting overview of an example environment in which various embodiments of providing remote-control special modes may be implemented. FIG. 1 illustrates just one example of an environment 102 and the various embodiments discussed herein are not limited to such environments. In particular, environment 102 and the various devices therein may contain other devices, systems and/or media not specifically described herein.

Example embodiments described herein provide applications, tools, data structures and other support to implement remote-control special modes. Other embodiments of the described techniques may be used for other purposes, including implementing special modes on other receiving devices, such as audio and DVD players, digital recorders, computers, peripherals, televisions, mobile devices, smart phones, and other electronic devices, etc. In the following description, numerous specific details are set forth, such as data formats, program sequences, processes, and the like, in order to provide a thorough understanding of the described techniques. The embodiments described also can be practiced without some of the specific details described herein, or with other specific details, such as changes with respect to the ordering of the code flow, different code flows, and the like. Thus, the scope of the techniques and/or functions described are not limited by the particular order, selection, or decomposition of steps described with reference to any particular module, component, or routine.

Figure 2:
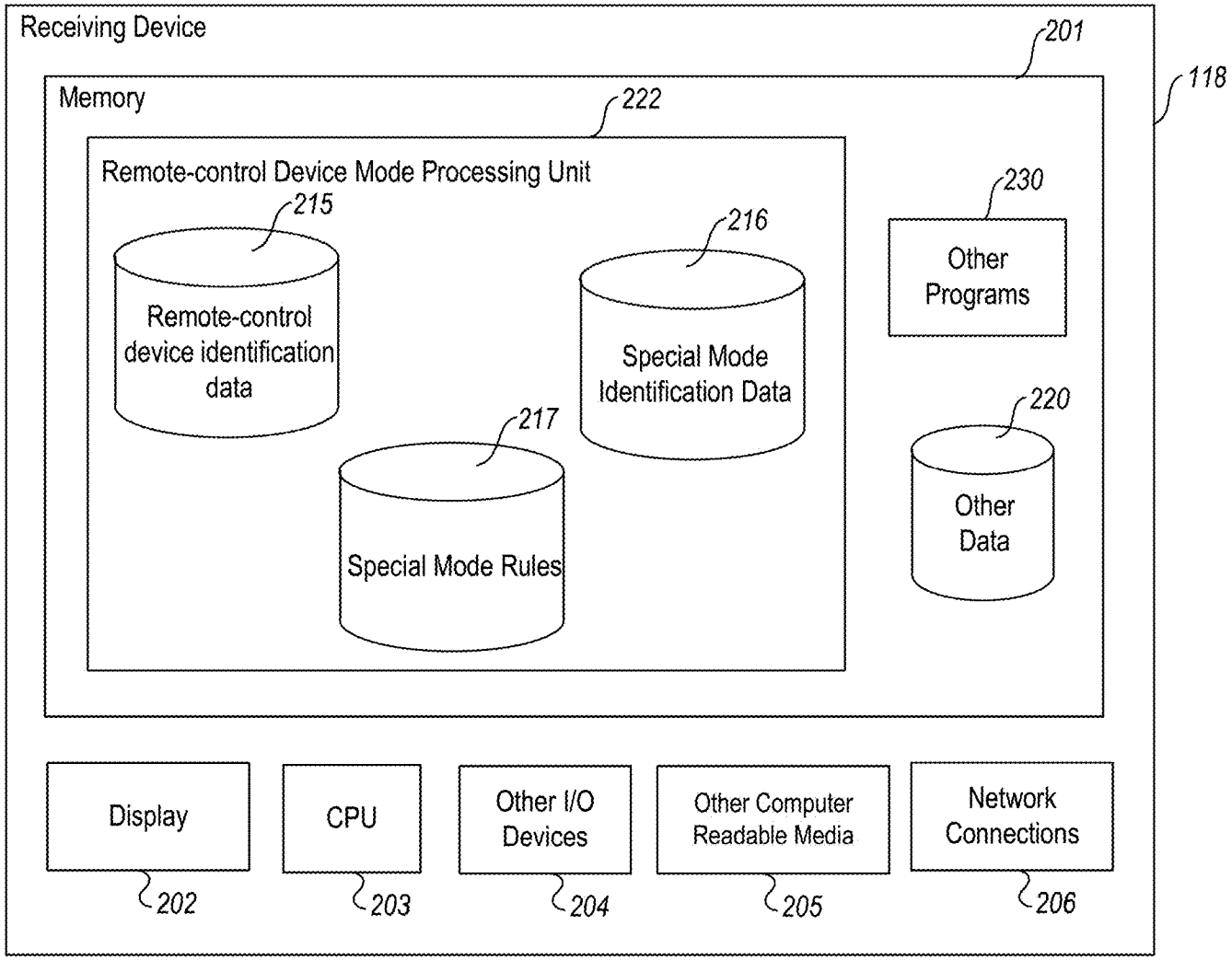
FIG. 2 is a block diagram illustrating elements of an example receiving device used in providing remote-control special modes, according to one example embodiment.

FIG. 2 is a block diagram illustrating elements of an example receiving device 118 used in providing remote-control special modes, according to one example embodiment.

One or more general purpose or special purpose computing systems/devices may be used to operate the receiving device 118; store remote-control identification data, remote-control special mode rules, and remote-control device special mode identification data, including such structures and data as that shown in FIG. 4A and FIG. 4B. In addition, the receiving device 118 may comprise one or more distinct computing systems/devices and may span distributed locations. Furthermore, each block shown may represent one or more such blocks as appropriate to a specific embodiment or may be combined with other blocks. Also, a remote-control device mode processing unit 222 may be implemented in software, hardware, firmware, or in some combination to achieve the capabilities described herein, including implementation of those algorithms described in FIGS. 5 through 8.

In the embodiment shown, receiving device 118 comprises a computer memory ("memory") 201, a display 202, one or more Central Processing Units ("CPU") 203, Input/Output (I/O) devices 204 (e.g., keyboard, mouse, RF or infrared receiver, light emitting diode (LED) panel, cathode ray tube (CRT) or liquid crystal display (LCD), USB ports, other communication ports, and the like), other computer-readable media 205, and network connections 206. The remote-control device mode processing unit 222 is shown residing in memory 201. In other embodiments, some portion of the contents and some, or all, of the components of the remote-control device mode processing unit 222 may be stored on and/or transmitted over the other computer-readable media 205. The components of the receiving device 118 and remote-control device mode processing unit 222 preferably execute on one or more controllers, such as CPUs 203 and facilitate the providing of remote-control special modes, as described herein, including implementation of those algorithms described in FIGS. 5 through 8. The remote-control device mode processing unit 222 also facilitates receiving and storage of remote-control identification data, remote-control special mode rules, and remote-control device special mode identification data, and communication with peripheral devices via the I/O devices 204 and with remote systems that provide programming content via the network connections 206.

Remote-control device identification data may reside on remote-control device identification data repository 215. Remote-control device identification data may be data that uniquely identifies remote-control devices of receiving device 118. For example, the remote-control device identification data may a string of alphanumeric characters that is associated with or uniquely identifies a particular remote-control device, such as remote-control device 128 or remote-control device 130. In some embodiments, the remote-control device identifier may be a media access control address (MAC address) address assigned to the remote-control device or hardware of the remote-control device that is different than the MAC address for other remote-control devices of the receiving device 118. Other identifiers may be used such as identification numbers or codes to uniquely identify the remote-control device. In some embodiments, such an identifier may be selected and/or assigned by a user to the various remote-control devices of the receiving device 118 Such identifiers may be stored in remote-control device identification data repository 215.

Special mode identification data may be stored in special mode identification data repository 216. The special mode identification data may include data such as unique identifiers of various special modes that may be assigned to remote-control devices, such as remote-control device 128 and remote-control device 130 of receiving device 118. These may be names of various remote-control device special modes or identification numbers or codes associated various remote-control device special modes that uniquely identify the various remote-control device special modes. In this manner, the remote-control device mode processing unit 222 may assign particular remote-control devices to particular remote-control device special modes by storing in memory 201 an association of the remote-control device identifier stored in remote-control device identification data repository 215 with the identifier of the special mode to which the remote-control device having that identifier is assigned.

Special mode rules repository 217 stores rules, instructions and/or options regarding what actions are to be performed when particular commands are received from a remote-control device that is assigned to a special mode. For example, remote-control device 128 may be assigned to a special music mode as indicated by a stored association in memory 201 of the identifier of remote-control device 128 stored in remote-control device identification data repository 215 with the identifier of the special music mode stored in special mode identification data repository 216. The special mode rules repository 217 stores what actions are to be performed by the receiving device 118 when commands are received from the remote-control device 128 based on the remote-control device 128 being assigned to the music mode. This may be, for example, to change the channel to a channel within a list of music channels whenever a command is received from the remote-control device 128 to change a channel on the receiving device 118, even if a current channel of the receiving device 118 is not a music service channel and the next channel is not a music service channel. The special mode rules repository 217 may also store rules to ignore certain commands received from remote-control devices that are in various limited use modes, according to which limited use mode the applicable remote-control device is currently in according to the identifier of the remote-control device stored in the remote-control device identification data repository 215.

In some embodiments, the other data repository 220 may include lists of channels associated with particular remote-control devices identified in the remote-control device identification data repository. The special mode rules 217 may include rules such that only those channels that are in the list of channels associated with the particular remote-control devices may be tuned to by the receiving device 118 when a channel change command is received from that particular remote-control device. Different modes may be associated with different types of lists that are each associated with different remote-control devices based on the remote-control device identification data stored in the remote-control device identification data repository 215. For example, remote-control device 128 made be assigned to a child favorites mode such that only those channels that are in the child's favorites list associated with remote-control device 128 in memory 201 may be tuned to by the receiving device 118 when a channel change command is received from that particular remote-control device 128. As another example, remote-control device 128 made be assigned to a grandparent favorites mode such that only those channels that are in the grandparent's favorites list associated with remote-control device 128 in memory 201 may be tuned to by the receiving device 118 when a channel change command is received from that particular remote-control device 128.

Such rules stored in the special mode rules repository 217 may include a list of commands, a process or a macro to perform based on the remote-control device from which the command is received being in a special mode. The rules may be selectable and configurable by a user such that the user may create customized special modes that may be saved in memory 201 and which may be assigned a special mode identifier stored in special mode identification repository 216. The rules stored in the special mode rules repository 217 may cause the receiving device 118 to execute a different command or process than it would have normally performed when receiving such a command from a remote-control device that is not assigned to the special mode. Such rules may include information regarding, but not limited to: under what circumstances and when an action is to be performed based on the remote-control device from which the command is received being in a special mode; specific actions to perform based on the remote-control device from which the command is received being in a special mode according to options that may be provided to the user via a menu or other graphical user interface element; specific actions to perform based on the remote-control device from which the command is received being in a special mode according to user profiles; specific actions to perform based on the remote-control device from which the command is received being in a special mode according to user preferences.

Such rules stored in the special mode rules repository 217 may be selected and set per user, saved in a corresponding user's profile stored in the special mode rules repository 217, other data repository 220 or remote system accessible via the receiving device 118. Such rules stored in the special mode rules repository 217 may also, or instead, be part of a master user control system profile stored in the special mode rules repository 217, other data repository 220, or remote system accessible via the receiving device 118.

Also, the remote-control device mode processing unit 222 may interact via a communication system 108 with other devices. For example, the other device may be a home computing system (e.g., a desktop computer, a laptop computer, etc.) that includes or has access to (e.g., via communication system 108) the functionality of the receiving device 118, remote-control device identification data, special mode rules, special mode identification data and other information to be stored in memory 201.

Other code or programs 230 (e.g., an audio/video processing module, a program guide manager module, a Web server, and the like), and potentially other data repositories, such as data repository 220 for storing other data (user profiles, preferences and configuration data, etc.), also reside in the memory 201, and preferably execute on one or more CPUs 203. Of note, one or more of the components in FIG. 2 may or may not be present in any specific implementation. For example, some embodiments may not provide other computer readable media 205 or a display 202.

In some embodiments, in response to a user command to do so, the remote-control device mode processing unit 222 may assign a remote-control device of the receiving device 118, such as remote-control device 128, to a special mode. In some embodiments, such a command to assign the remote-control device 128 to a special mode may be received by the remote-control device mode processing unit 222 from remote-control device 128. The remote-control device mode processing unit 222 then assigns remote-control device 128 to a special mode by storing in memory 201 an association of an identifier unique to the remote-control device 128 retrieved from remote-control device identification data repository 215 with the particular special mode identifier retrieved from special mode identification data repository 216 to which the remote-control device 128 is being assigned. This unique identifier of the remote-control device 128 is received with each command that is received from a remote-control device by the remote-control device mode processing unit 222, such as from remote-control device 128 or from remote-control device 130. When the remote-control device mode processing unit 222 receives a command from a remote-control device, such as from remote-control device 128 or remote-control device 130, the remote-control device mode processing unit 222 will read the unique identifier received with the command and determine whether there has been a special mode assigned to the remote-control device having that unique identifier by searching memory 201 for such an association.

For example, the remote-control device mode processing unit 222 may receive a command from remote-control device 128 and determine that there has been a special mode assigned to the remote-control device 128 based on the stored association of the identifier unique to the remote-control device 128 with the particular special mode. The remote-control device mode processing unit 222 will then interpret the command received from the remote-control device 128 according to how commands are to be processed in the special mode as indicated in the special mode rules repository 217. The remote-control device mode processing unit 222 having the remote-control device 128 assigned to the special mode may cause the receiving device 118 to execute a different command or process than it would have normally performed when receiving such a command from a remote-control device that is not assigned to the special mode.

In some embodiments, the receiving device 118 and remote-control device mode processing unit 222 include an application program interface ("API") that provides programmatic access to one or more functions of the receiving device 118 and remote-control device mode processing unit 222. For example, such an API may provide a programmatic interface to one or more functions of the remote-control device mode processing unit 222 that may be invoked by one of the other programs 230 or some other module. In this manner, the API may facilitate the development of third-party interfaces, plug-ins, and the like, to facilitate the providing remote-control special modes as described herein. For example, adapters such an API may facilitate for integrating functions of the remote-control device mode processing unit 222 into desktop applications such that a user may customize special modes and assign remote-control devices to special modes remotely from the receiving device 118.

In an example embodiment, components/modules of the receiving device 118 and remote-control device mode processing unit 222 are implemented using standard programming techniques. For example, the remote-control device mode processing unit 222 may be implemented as a "native" executable running on the CPU 203, along with one or more static or dynamic libraries. In other embodiments, the remote-control device mode processing unit 222 may be implemented as instructions processed by a virtual machine that executes as one of the other programs 230. In general, a range of programming languages known in the art may be employed for implementing such example embodiments, including representative implementations of various programming language paradigms, including, but not limited to, object-oriented (e.g., Java, C++, C#, Visual Basic.NET, Smalltalk, and the like), functional (e.g., ML, Lisp, Scheme, and the like), procedural (e.g., C, Pascal, Ada, Modula, and the like), scripting (e.g., Perl, Ruby, Python, JavaScript, VBScript, and the like), or declarative (e.g., SQL, Prolog, and the like). Various image, graphics, and video processing platforms, standards, encoding and decoding techniques and APIs may be utilized accordingly in the implementation of the components/modules of the receiving device 118 and remote-control device mode processing unit 222.

In a software or firmware implementation, instructions stored in a memory configure, when executed, one or more processors of the receiving device 118 to perform the functions of the remote-control device mode processing unit 222. In one embodiment, instructions cause the CPU 203 or some other processor, such as an I/O controller/processor, to perform the actions of the receiving device 118 and remote-control device mode processing unit 222 described herein. For example, this may include, but is not limited to, generating and/or receiving remote-control device identification data, special mode identification data, special mode rules and performing actions in response to a command received from a remote-control device that is assigned to a special mode according to the special mode rules. Some or all of the actions of the receiving device 118 and remote-control device mode processing unit 222 described herein may instead or also be performed by a remote system, repeater or some other module in communication with the receiving device 118.

The embodiments described above may also use well-known or other synchronous or asynchronous client-server computing techniques. However, the various components may be implemented using more monolithic programming techniques as well, for example, as an executable running on a single CPU computer system, or alternatively decomposed using a variety of structuring techniques known in the art, including, but not limited to, multiprogramming, multi-threading, client-server, or peer-to-peer, running on one or more computer systems, each having one or more CPUs. Some embodiments may execute concurrently and asynchronously, and communicate using message passing techniques. Equivalent synchronous embodiments are also supported by the remote-control device mode processing unit 222 implementation. Also, other functions could be implemented and/or performed by each component/module, and in different orders, and by different components/modules, yet still achieve the functions of the receiving device 118 and remote-control device mode processing unit 222.

In addition, programming interfaces to the data stored as part of the receiving device 118 and remote-control device mode processing unit 222, can be available by standard mechanisms such as through C, C++, C#, and Java APIs; libraries for accessing files, databases, or other data repositories; scripting languages such as XML; or Web servers, FTP servers, or other types of servers providing access to stored data. The remote-control device identification data repository 215, special mode rules repository 217, or special mode identification data repository 216 may be implemented as one or more remote or local database systems, file systems, or by any other techniques for storing such information, or any combination of the above, including implementations using distributed computing techniques.

Different configurations and locations of programs and data are contemplated for use with techniques described herein. A variety of distributed computing techniques are appropriate for implementing the components of the illustrated embodiments in a distributed manner including, but not limited to, TCP/IP sockets, RPC, RMI, HTTP, and Web Services (XML-RPC, JAX-RPC, SOAP, and the like). Other variations are possible. Other functionality could also be provided by each component/module, or existing functionality could be distributed amongst the components/modules in different ways, yet still achieve the functions of the remote-control device mode processing unit 222.

Furthermore, in some embodiments, some or all of the components of the receiving device 118 and remote-control device mode processing unit 222 may be implemented or provided in other manners, such as at least partially in firmware and/or hardware, including, but not limited to, one or more application-specific integrated circuits ("ASICs"), standard integrated circuits, controllers (e.g., by executing appropriate instructions, and including microcontrollers and/or embedded controllers), field-programmable gate arrays ("FPGAs"), complex programmable logic devices ("CPLDs"), and the like. Some or all of the system components and/or data structures may also be stored as contents (e.g., as executable or other machine-readable software instructions or structured data) on a computer-readable medium (e.g., as a hard disk; a memory; a computer network, cellular wireless network or other data transmission medium; or a portable media article to be read by an appropriate drive or via an appropriate connection, such as a DVD or flash memory device) so as to enable or configure the computer-readable medium and/or one or more associated computing systems or devices to execute or otherwise use, or provide the contents to perform, at least some of the described techniques. Some or all of the system components and data structures may also be stored as data signals (e.g., by being encoded as part of a carrier wave or included as part of an analog or digital propagated signal) on a variety of computer-readable transmission mediums, which are then transmitted, including across wireless-based and wired/cable-based mediums, and may take a variety of forms (e.g., as part of a single or multiplexed analog signal, or as multiple discrete digital packets or frames). Such computer program products may also take other forms in other embodiments. Accordingly, embodiments of this disclosure may be practiced with other computer system configurations.

Figure 3:
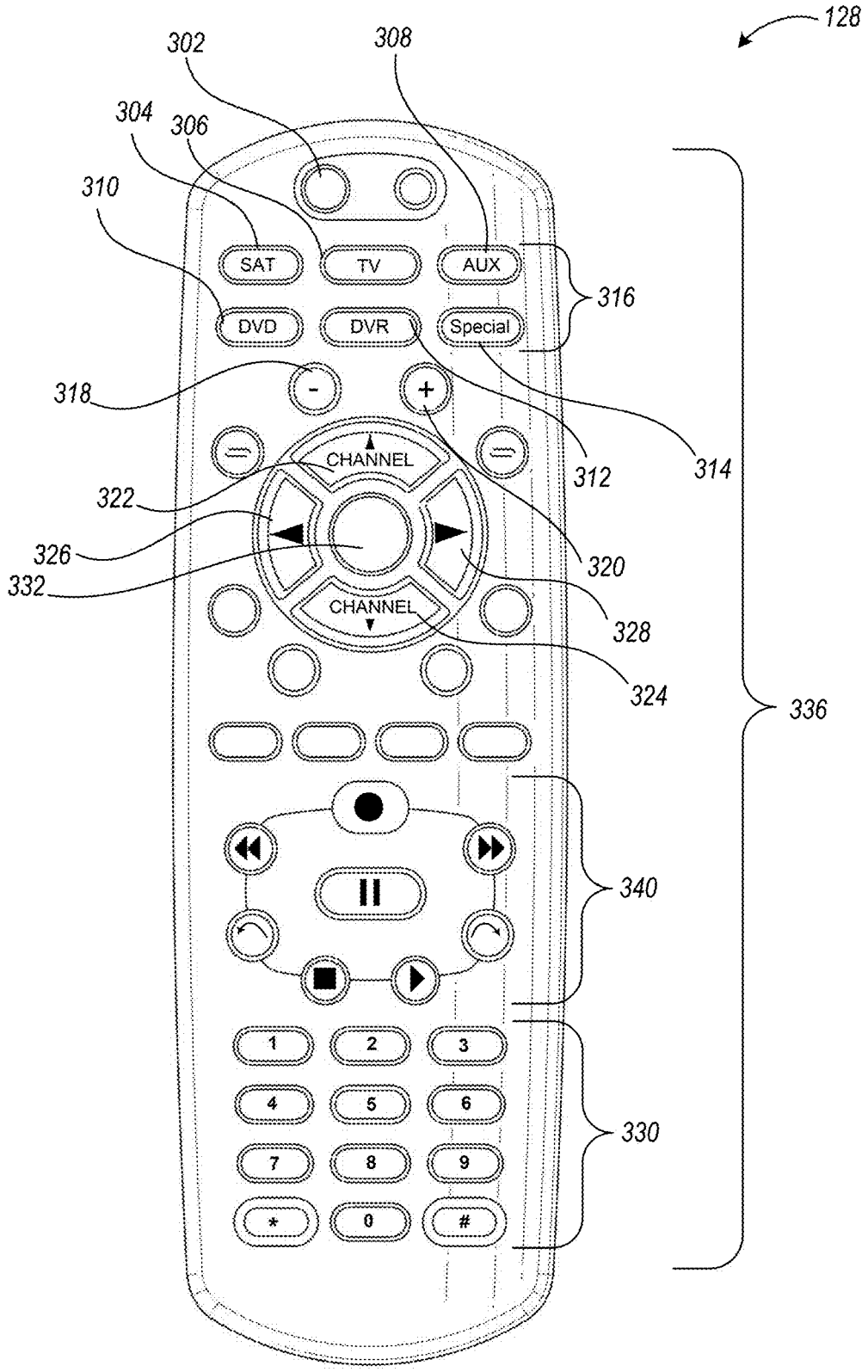
FIG. 3 is a diagram illustrating a top plan view of an example embodiment of a remote-control device for which remote-control special modes may be provided, according to one example embodiment.

FIG. 3 is a diagram illustrating top plan view of an example embodiment of a remote-control device 128 for which remote-control special modes may be provided, according to one example embodiment. Shown is the remote 128 according to one example embodiment. However, different buttons, different button configurations and various different types of input controls may be present in various other embodiments.

Included on the example remote 128 shown in FIG. 3 is an example group of controls 336. The group of controls 336 includes a power button 302; a plurality of mode buttons 316, including a satellite mode button 304, a TV mode button 306, an auxiliary mode button 308, a DVD mode button 310, a DVR mode button 312 and a "Special" mode button 314; a volume down button 318, a volume up button 320; a channel up button 322 (which also operates as an up directional key); a channel down button 324 (which also operates as a down directional key); a left directional key 326; a right directional key 328; a select button 332; a set of media player control buttons 340, including record, play, pause, fast forward, rewind, skip forward and skip backward buttons; and a numeric keypad 330. Additional or different controls may also be present on the back of the remote 128, for example a QWERTY keyboard, which may be active or inactive in various different modes.

In some embodiments, the user may assign the remote-control device 128 to a special mode by pressing the "Special" mode button 314. For example, this may cause a command to be sent to the receiving device 118 to store on the receiving device 118 an association of a unique identifier of the remote-control device 128 with a particular special mode. The special mode may be a mode that causes the receiving device to perform special functions or a special process when particular controls within the group of controls 336 are activated by the user that the receiving device 118 would not normally perform when such controls are activated. For example, the special mode to which remote-control 128 is assigned when the "Special" mode button is activated may be a special music mode. Then in response to receiving a command from the remote-control device 128 resulting from activation of the channel up button 322 to change to a next higher channel, the receiving device 118 may instead first take the receiving device 118 out of standby mode if it is currently in standby mode and then jump to the first channel in a list of music service channels instead of changing to the next higher channel numerically, which may be a television channel. If the next higher channel is in fact a music service channel, then the receiving device 118 will change to this next music service channel while the remote-control device 128 is assigned to the special music mode. Similarly, in response to receiving a command from the remote-control device 128 resulting from activation of the channel down button 324 to change to a next lower channel, the receiving device 118 may instead first take the receiving device 118 out of standby mode if it is currently in standby mode and then jump to the first channel in a list of music service channels instead of changing to the lower channel numerically, which may be a television channel. If the next lower channel is in fact a music service channel, then the receiving device 118 will change to this next music service channel while the remote-control device 128 is assigned to the special music mode.

In some embodiments, a user pressing the "Special" mode button 314 may cause a command to be sent to the receiving device 118 to display a menu or otherwise provide options for the user to select a special mode from a plurality of special modes to which the remote-control device 128 may be assigned. For example, such modes may be limited use modes that limit use of functionality provided by the remote-control device 128. In some embodiments, the receiving device 118 having the remote-control device 128 assigned to the special limited use mode may cause the receiving device 118 to ignore certain commands received from the remote-control device 128 or execute a different command or process than it would have normally performed when receiving such a command from a remote-control device that is not assigned to the limited use mode. This may be useful in cases where the user desires to limit what functions the remote-control device can cause the receiving device 118 to perform to preserve settings or prevent certain channels from being viewed, such as when the remote-control device 128 is being used by children or other users.

The list of commands that may be limited according to the various limited use modes are commands to perform one or more operations including at least one of: recording content, playing recorded content, performing menu operations, performing guide operations, changing system settings, changing receiving device settings, changing user preferences, changing menu settings, changing guide settings, changing favorites lists, playing particular programs, playing particular content; switching to particular channels, changing source input, changing remote-control device modes, changing parental control settings, changing user credentials, changing television settings, changing auxiliary device settings, changing volume, turning on or off muting, changing closed captioning settings, changing subtitle settings, changing video settings, changing audio settings, changing display mode settings, changing content recording settings, changing future program recording settings, changing alerts, changing home automation settings, and changing home security settings.

For example, there may be a limited use mode to prevent use of one or more of the other mode buttons 316 to prevent changes by the remote-control device 128 to other modes. One embodiment includes a limited use mode to prevent use of media player control buttons 340, including record, play and other functions. As another example, there may be a limited use mode to prevent use of the numeric keypad 330 or use of additional or different controls present on the back of the remote 128, for example a QWERTY keyboard. Indications of such restricted commands associated with those controls on the remote-control device 128 may be stored in memory 201 of the receiving device 118 in a list of restricted commands along with an association of the list of restricted commands with the particular limited use mode. For example, after the remote-control device 128 is assigned the limited use mode limiting use of the media player controls on the remote-control device 128, when the receiving device 118 then receives a command that is included in a restricted list of commands associated with that particular limited use mode, such as by a user pressing one of the media player control buttons 340, the receiving device 118 will ignore the command. For various modes, a channel change command that is limited or restricted may be a command to change to a next channel by activation of channel up button 322, channel down button 324 or by direct channel number input via keypad 330.

Also, which of the controls 336 are to be limited in particular limited use modes may be selected by the user. A menu for selection of which of the controls 336 are limited in particular limited use modes may appear as a result of or as part of a menu that appears in response to the user pressing the "Special" mode button on the remote-control device 128. Such special limited use modes may persist on the remote-control device 128 for a limited time, the length of which may be selected by a user, and/or until the receiving device 118 receives a command from a different remote-control device that is determined by the receiving device 118 to currently not be in the special limited use mode. Whether and which special limited use modes persist for a limited time or until the receiving device 118 receives a command from a different remote-control device that is determined by the receiving device 118 to currently not be in the special limited use mode may also be selectable by the user via a user interface. Such user interfaces for customizing limited use modes and limited use mode settings may be provided by the receiving device 118, a computer or a user's mobile device. In some embodiments, a user must be logged in to an authorized account or otherwise be authenticated to assign the remote-control device 128 to a special mode, to remove the remote-control device 128 from being assigned to the special mode and/or to create special modes or customize special mode settings for the remote-control device 128. Such authentication may be performed via a biometric sensor (not shown) of the remote-control device 128 or other authentication methods.

Additional, fewer, or different buttons or other controls may also be present in the group of controls 336 corresponding to other or different functionality of various devices. For example, in some embodiments, the remote-control device 128 does not include a "Special" mode button 314 and the user may have the receiving device 118 assign the special mode to the remote-control device 128 via a user interface on the receiving device 118 itself. Other buttons or controls may control other media device settings, on-demand services, purchase requests, and general menu and graphical user interface (GUI) navigation. The dimensions and overall shape of the remote 128 may vary depending on the positioning and placement of the group of controls 336, the positioning of the particular internal electronics of the remote 128 components shown in FIG. 2, and any modifications for ease and comfort of use of the remote 128.

Other menus, interfaces and applications may be displayed and controlled using the remote 128 directional keys 322, 324, 326, 328 to control movement of the cursor or other menu navigation and/or using the keypad 330 and/or QWERTY keyboard (not shown) on the back of the remote 128 to enter text or other input into the various menus, interfaces and applications in communication with the presentation device 120, auxiliary device 132 and/or the receiving device 118. Examples of such other menus, interfaces and applications include, but are not limited to, menus, interfaces and applications of: televisions, satellite and cable receivers, DVD players, game consoles, computers, mobile devices, tablets, and computer networks. Other such examples include digital video or audio recorders or players, analog video or audio recorders or players, stereo equipment, home appliances, mobile devices, MP3 players, cellular phones, home entertainment systems, home theater systems, smart home systems, home electromechanical systems, such as a lighting system, security system, climate control system, spa/pool, and the like, or other media devices, etc.

In various special modes, the restriction on use of a command or control 336 on the remote-control device 128, or the interpretation of a command or control 336 on the remote-control device 128, may be conditional or depend on what menu or interface is being output by the receiving device to the presentation device 120. For example, the channel change button 322 (which also operates as an up directional key) and the channel down button 324 (which also operates as a down directional key) may be received or interpreted by the receiving device 118 as a channel change command or a menu navigation command depending on whether there is a menu being output by the receiving device to the presentation device 120 and thus, the remote-control device 128 being a special mode will cause the receiving device 118 to process the command accordingly based on how the special mode handles such commands.

Additional or different special modes and corresponding special mode buttons may be included on the remote 128 in various other embodiments. In some embodiments, the remote 128 may also or instead be assigned by the receiving device 118 to a number of different special modes, each special mode corresponding to a particular physical orientation, switch position, current menu or interface selected, current device being communicated with, or a combination of the foregoing items. The current menu or device with which the remote 128 is communicating may also affect the particular mode to which the remote 128 is assigned. In some embodiments, this may be enabled by two-way communication between the remote 128 and the receiving device 118.

The ability to have the remote 128 be assigned to particular special modes may be limited to, or otherwise based on, particular users or permissions. For example, a user may be identified by the remote 128, or other system in communication with the remote 128, as an authorized user or as a user otherwise having permission to cause the remote 128 to be assigned to a particular special mode. This may be performed by a fingerprint scanner on the remote 128 (not shown), by other biometric identification of the user or by the user otherwise providing credentials for authentication to the remote 128 or a system in communication with the remote 128. For example, the ability to have the remote 128 be assigned to particular special modes may be password protected, such that the user must provide a password or other identifier (e.g., a PIN, biometric identifier, etc.) to access this protected feature.

FIG. 4A is a table 400*a* illustrating an example of how commands received from a remote-control device by a receiving device may be interpreted by the receiving device according to remote-control special modes, according to one example embodiment. The table 400*a* and/or the data represented in the table 400*a*, or portions thereof, may be stored on and/or generated by the receiving device 118, such as in memory 201, and/or a remote system. Table 400*a* shows some example special modes 404*a*, 404*b*, 404*c* and 404*d* and actions or processes that may be performed when particular commands are received by the receiving device 118 from the remote-control device 128 while the receiving device is in each of the special modes 404*a*, 404*b*, 404*c* and 404*d*.

In particular, column 402*a* indicates the identifiers of the example special modes. In the present example the identifier of each special mode is the name of the special mode, but the identifier may also be a code a numerical string or any other unique identifier. The example special modes shown are "Music Mode" 404*a*, "Limited Use Mode A" 404*b*, "Limited Use Mode B" 404*c*, and "Limited Use Mode C" 404*d*. Column 402*b* includes the command or process to be performed when the remote-control device 128 is assigned to the corresponding mode shown in table 400*a* when example "Command 1" is received by the receiving device 118 from the remote-control device 128. Column 402*c* includes the command or process to be performed when the remote-control device 128 is assigned to the corresponding mode shown in table 400*a* when example "Command 2" is received by the receiving device 118 from the remote-control device 128. Column 402*d* includes the command or process to be performed when the remote-control device 128 is assigned to the corresponding mode shown in table 400*a* when example "Command 3" is received by the receiving device 118 from the remote-control device 128.

When remote-control device 128 is assigned to the "Music Mode" and the receiving device 118 then receives "Command 3" from the remote-control device 128, instead of performing "Command 3" the receiving device 118 will perform "process h". For example, if "Command 3" is the "channel up" command received as result of the user pressing the channel up button 322 on the remote-control device 128 shown in FIG. 3, then instead of performing the "channel up" command, the receiving device performs "process h". In one example, "process h" may be to first take the receiving device 118 out of standby mode if it is currently in standby mode and then jump to the first channel in a list of music service channels instead of to the next channel numerically, which may be a television channel. If the next channel is in fact a music service channel, then the receiving device 118 will change to this next music service channel. In some embodiments the list of music service channels may be a list of favorite music channels selected by the user and associated with the remote-control device 128.

FIG. 4B is a table 400*b* illustrating an example of how particular remote-control devices may be assigned by a receiving device to particular special modes, according to one example embodiment. The table 400*b* and/or the data represented in table 400*b*, or portions thereof, may be stored on and/or generated by the receiving device 118, such as in memory 201, and/or a remote system. Table 400*b* shows a list of example remote-control devices under column 406*a* and the corresponding special mode to which each remote-control device is currently assigned under column 406*b*.

In particular, column 406*a* indicates example identifiers of the example remote-control devices including remote-control device identifier "123" 408*a*, remote-control device identifier "124" 408*b* and remote-control device identifier "125" 408*c*. In the present example, the identifier of a remote-control device is a numerical string, but the identifier may also be a code an address (e.g., a MAC address) or any other unique identifier. In the present example, table 400*b* shows that the remote-control device having identifier "123" 408*a* is assigned to "Music Mode", the remote-control device having identifier "124" 408*b* is assigned to "Limited Use Mode B" and the remote-control device having identifier "125" 408*c* is assigned to "Limited Use Mode A". Therefore, when a command is received by the receiving device 118 from the remote-control device having identifier "123" 408*a* (for example, remote-control device 128), then receiving device 118 will execute the command interpreted according to the "Music Mode" as indicated in table 400*a*. For example, when the receiving device 118 then receives "Command 3" from the remote-control device having identifier "123" 408*a*, instead of performing "Command 3" the receiving device 118 will perform "process h" according to table 400*a*.

Figure 5:
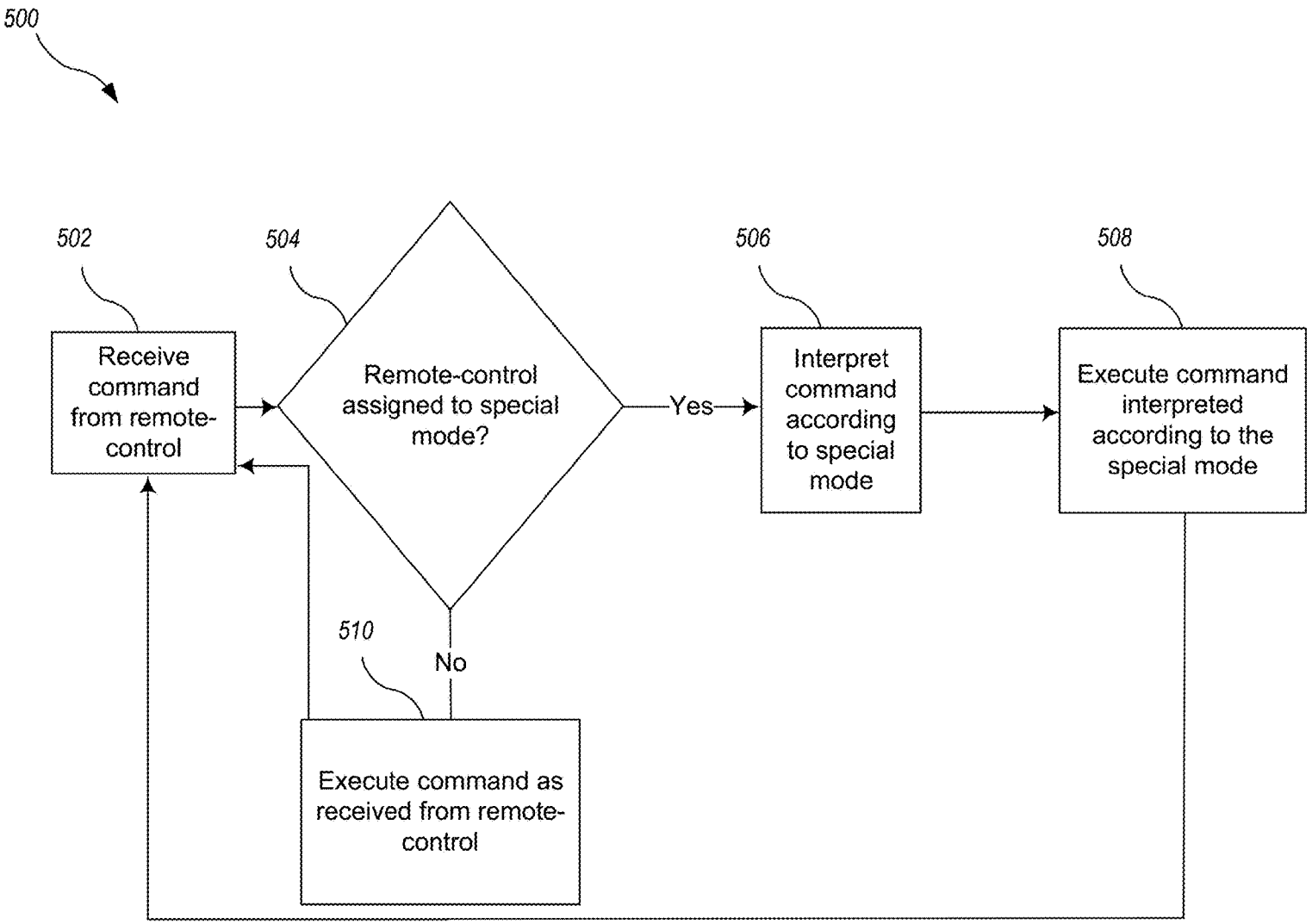
FIG. 5 is a flow diagram of an algorithm for providing remote-control special modes, according to a first example embodiment.

FIG. 5 is a flow diagram of an algorithm 500 for providing remote-control special modes, according to a first example embodiment.

At 502, the receiving device 118, receives a command from the remote-control device 128.

At 504, in response to receiving the command, the receiving device 118 makes a determination whether the remote-control device 128 is currently assigned to a special mode.

If the receiving device 118 determines the remote-control device 128 is currently assigned to a special mode, the algorithm proceeds to 506.

At 506, the receiving device 118 interprets the command according to special mode.

At 508, the receiving device 118 executes the command interpreted according to special mode and then proceeds back to 502.

If the remote-control device 128 is currently assigned to a special mode, the algorithm proceeds to 506.

If the receiving device 118 determines the remote-control device 128 is not currently assigned to a special mode, the algorithm proceeds to 510.

At 510, the receiving device 118 executes the command as received from remote-control device 128.

Figure 6:
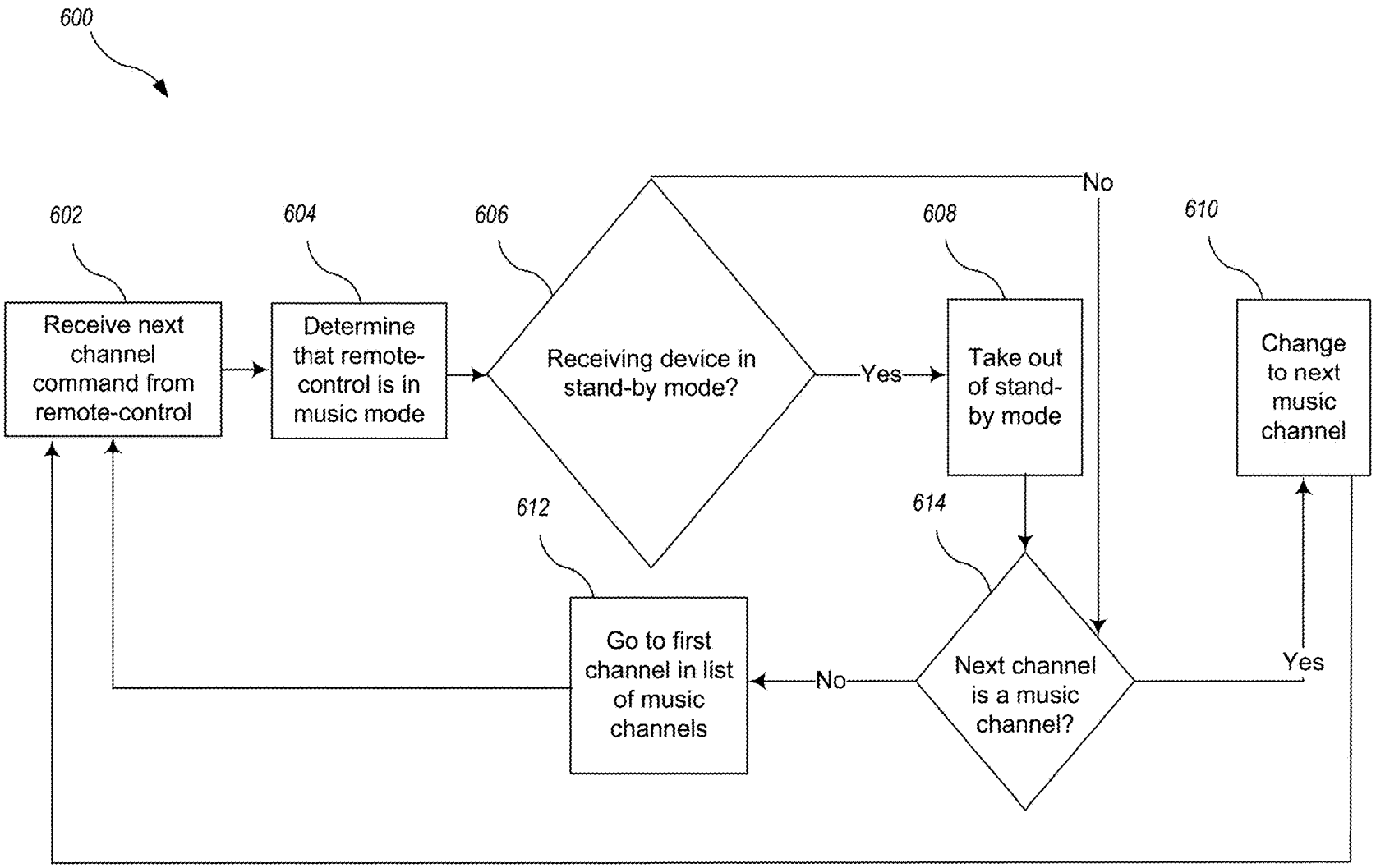
FIG. 6 is a flow diagram of an algorithm for providing remote-control special modes, according to a second example embodiment.

FIG. 6 is a flow diagram of an algorithm 600 for providing remote-control special modes, according to a second example embodiment.

At 602, the receiving device 118 receives a "next channel" command from the remote-control device 128. For example, this may be a "channel up" or a "channel down" command received as a result of the user pressing the corresponding channel up button 322 or channel down button 324 on remote-control device 128.

At 604, the receiving device 118 determines that the remote-control device 128 is in a special "Music Mode".

At 606, the receiving device 118 makes a determination whether the receiving device 118 is currently in a standby mode. A standby mode may be a mode where some or all of the functions or components of the receiving device 118 are in a temporary powered down or inactive state.

If the receiving device 118 determines the remote-control device 128 is currently in a standby mode, the algorithm proceeds to 608.

At 608, the receiving device 118 takes the receiving device 118 out of standby mode.

If the receiving device 118 determines the remote-control device 128 is not currently in a standby mode, the algorithm proceeds to 614.

At 614 the receiving device 118 determines whether the next channel numerically, either up or down according to the received command, is a music service channel. A music service channel is a channel that provides audio as the primary source of entertainment and may have no video, still video frames, or a screen saver video accompanying the audio.

If the receiving device 118 determines the next channel numerically is a music service channel, the algorithm proceeds to 610.

At 610, the receiving device 118 changes to the music service next channel and then proceeds back to 602. In some embodiments, the next music service may be a channel within a list of music service channels.

If the receiving device 118 determines the next channel numerically is not a music service channel, the algorithm proceeds to 612.

At 612, the receiving device 118 jumps to the first music channel in the list of music service channels if the next channel numerically, either up or down according to the received command, is not a music service channel and then proceeds back to 602. In some embodiments, the list of music service channels may be a list of music service channels associated specifically with the remote-control device 128 and may be selectable by the user.

Figure 7:
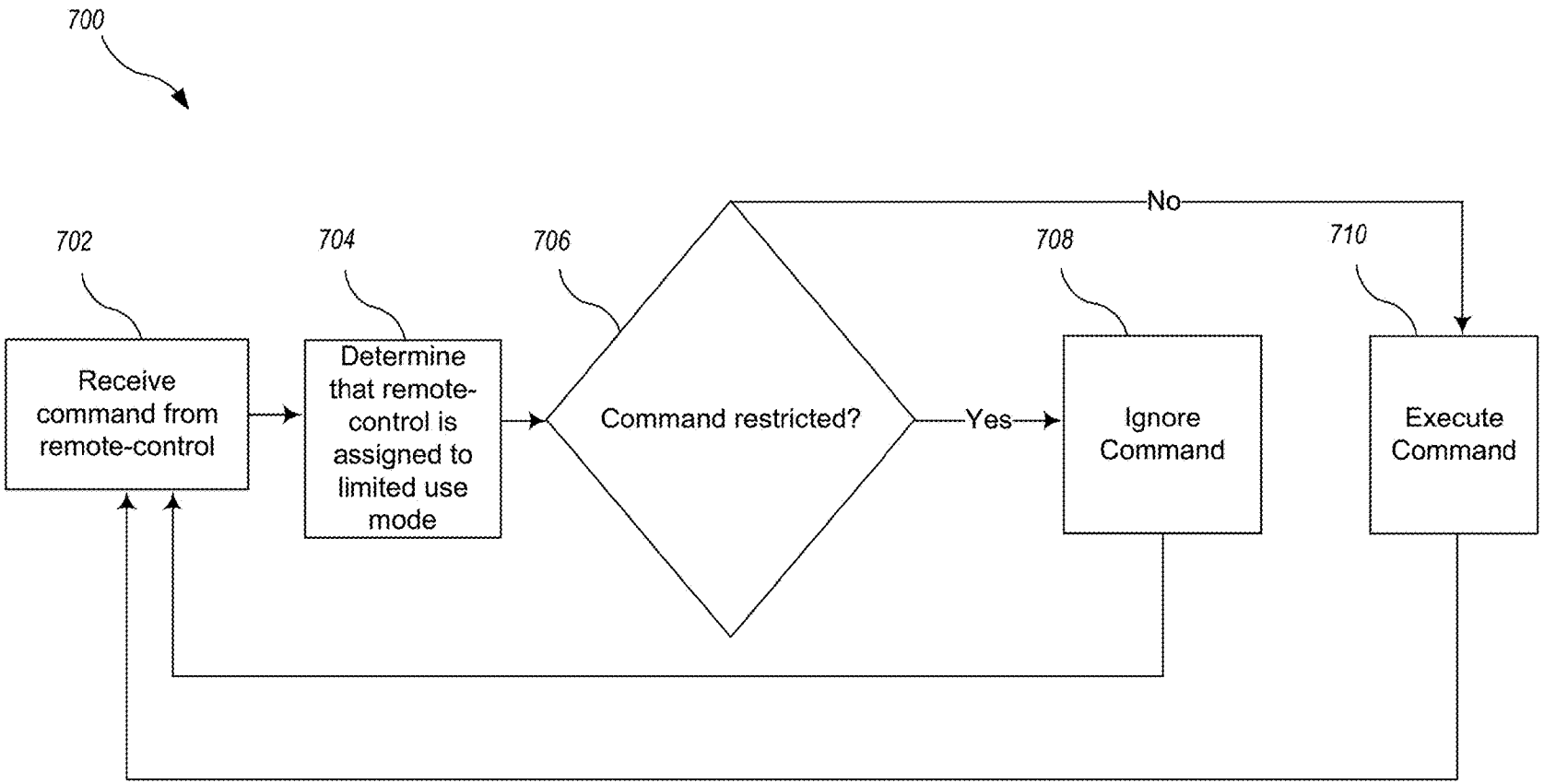
FIG. 7 is a flow diagram of an algorithm for providing remote-control special modes, according to a third example embodiment.

FIG. 7 is a flow diagram of an algorithm 700 for providing remote-control special modes, according to a third example embodiment.

At 702, the receiving device 118 receives a command from remote-control device 128.

At 704, the receiving device 118 determines that the remote-control device 128 is assigned to a limited use mode.

At 706, the receiving device 118 determines whether the received command is restricted according to the limited use mode currently assigned to remote-control device 128.

If the receiving device 118 determines that the received command is restricted according to the limited use mode currently assigned to remote-control device 128, then the algorithm proceeds to 708.

At 708, the receiving device 118 ignores the received command and then proceeds back to 702.

If the receiving device 118 determines that the received command is not restricted according to the limited use mode currently assigned to remote-control device 128, then the algorithm proceeds to 710.

At 710, the receiving device 118 executes the received command and then proceeds back to 702.

Figure 8:
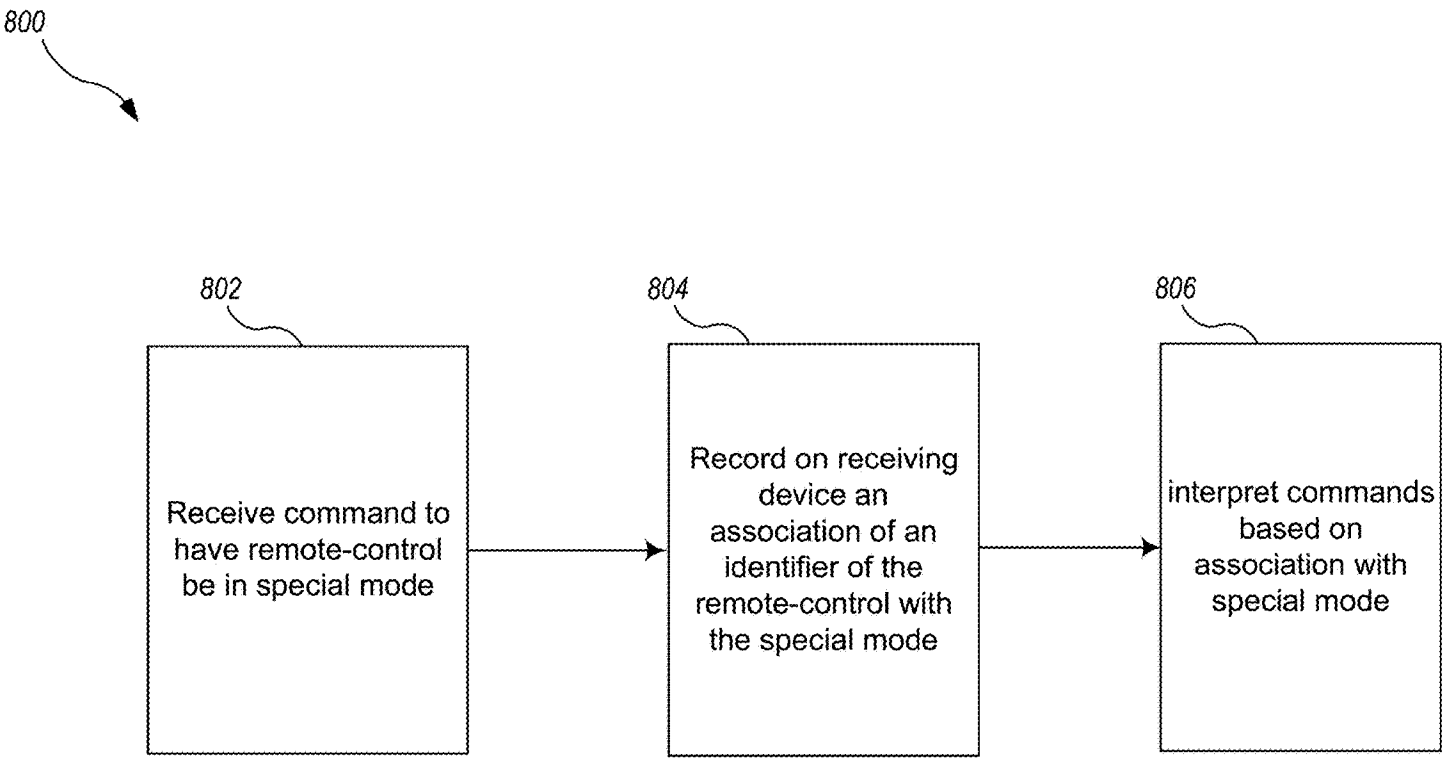
FIG. 8 is a flow diagram of an algorithm for remote-control special modes, according to a fourth example embodiment.

FIG. 8 is a flow diagram of an algorithm 800 for remote-control special modes, according to a fourth example embodiment.

At 802, the receiving device 118 receives a command to have the remote-control device 128 be in a special mode. The command may be received from the remote-control device 128, via an interface provided by or generated by the receiving device 118, or from another device remote from the receiving device 118.

At 804, the receiving device 118 records on the receiving device 118 an association of an identifier of the remote-control with the special mode.

At 806, the receiving device 118 interprets commands received from the remote-control device 128 based on association with the special mode.

While various embodiments have been described hereinabove, it is to be appreciated that various changes in form and detail may be made without departing from the scope of the invention(s) presently or hereafter claimed. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method for providing remote-control special modes, the method comprising:

receiving, by a receiving device, a command from a remote-control device of the receiving device to control a function of the receiving device;

in response to receiving the command from the remote-control device, determining, by the receiving device, whether the remote-control device is assigned to a special mode;

if it is determined by the receiving device that the remote-control device is assigned to a special mode, then:

interpreting, by the receiving device, the command received from the remote-control device according to the special mode; and executing, by the receiving device, the command interpreted according to the special mode; and if it is determined by the receiving device that the remote-control device is not assigned to a special mode, then executing the command as received by the receiving device from the remote-control device.

2. The method of claim 1 wherein the determining, by the receiving device, whether the remote-control device is assigned to a special mode includes:

reading, by the receiving device, an identifier of the remote-control device received with the command received from the remote-control device;

determining, by the receiving device, whether the received identifier of the remote-control device is associated with a special mode;

if the received identifier of the remote-control device is determined by the receiving device to be associated with a special mode, then determining, by the receiving device, that the remote-control device is assigned to the special mode; and if the received identifier of the remote-control device is determined by the receiving device to not be associated with a special mode, then determining, by the receiving device, that the remote-control device is not assigned to a special mode.

3. The method of claim 2 wherein the determining, by the receiving device, whether the received identifier of the remote-control device is associated with a special mode includes determining whether the received identifier of the remote-control device is associated with one of a plurality of special modes recognized by the receiving device.

4. The method of claim 1 wherein the special mode is a music channel mode in which commands from the remote-control device to change to a next channel on the receiving device are interpreted by the receiving device to change channels within a list of music service channels, even if a current channel of the receiving device is not a music service channel and the next channel is not a music service channel.

5. The method of claim 1 wherein the special mode is a limited use mode in which particular commands from the remote-control device are ignored by the receiving device.

6. The method of claim 1 wherein the determining, by the receiving device, whether the remote-control device is assigned to a special mode includes, in response to receiving the command from the remote-control device, determining, by the receiving device, that the remote-control device is currently assigned to a special music mode, and wherein executing, by the receiving device, the command interpreted according to the special mode includes:

the receiving device taking the receiving device out of a standby mode if the receiving device is in the standby mode; and if the receiving device determines the command from the remote-control device is a command to change to a next channel, the receiving device changing a current channel to a music service channel within a list of music service channels even if a current channel of the receiving device is not a music service channel and the next channel is not a music service channel.

7. The method of claim 6 wherein the receiving device changing the channel to a music service channel in a list of music service channels includes:

determining, by the receiving device, whether the remote-control device is currently associated with a list of favorite music service channels; and if it is determined, by the receiving device, that the remote-control device is currently associated with a list of favorite music service channels, then changing to a music service channel within the list of favorite music service channels currently associated with the remote-control device.

8. The method of claim 6 wherein executing, by the receiving device, the command interpreted according to the special mode further includes:

the receiving device inserting, into audio output of the music service channel to which the receiving device is changing, an audible indication of a channel identifier of the music service channel to which the receiving device is changing.

9. The method of claim 6 wherein executing, by the receiving device, the command interpreted according to the special mode further includes:

the receiving device outputting an audible indication of a status of the receiving device in conjunction with changing to the music service channel within the list of music service channels.

10. The method of claim 1 further comprising:

receiving, by the receiving device, another command from the remote-control device of the receiving device to control a function of the receiving device;

in response to receiving the other command from the remote-control device, determining, by the receiving device, that the remote-control device is currently assigned to a special music mode;

in response to the determining, by the receiving device, that the remote-control device is currently assigned to the special music mode:

if the receiving device determines the command from the remote-control device is a command to change to a next channel, the receiving device determining whether a current status of the receiving device does not allow changing to another channel; and if the receiving device determines the current status of the receiving device does not allow changing to another channel, the receiving device outputting an audio signal indicating that the current status of the receiving device does not allow changing to another channel.

11. The method of claim 1 further comprising:

receiving, by the receiving device, another command from the remote-control device of the receiving device to control a function of the receiving device;

in response to receiving the other command from the remote-control device, determining, by the receiving device, that the remote-control device is currently assigned to a special limited use mode;

in response to the determining, by the receiving device, that the remote-control device is currently assigned to the special limited use mode:

the receiving device determining whether the received other command is in a list of commands that are limited according to the special limited use mode; and if the receiving device determines the received other command is in a list of commands that are limited according to the special limited use mode, the receiving device determining not to execute the received other command.

12. The method of claim 11 wherein the list of commands that are limited according to the special limited use mode are commands to do one or more of: change settings of the receiving device and activate a menu on a display device in operable communication with the receiving device.

13. The method of claim 11 wherein the list of commands that are limited according to the special limited use mode are commands to change to channels other than channels on a list of allowed channels.

14. The method of claim 11 wherein the list of commands that are limited according to the special limited use mode are commands to change to a restricted list of channels.

15. The method of claim 11 wherein the list of commands that are limited according to the special limited use mode are commands to perform one or more operations including at least one of: recording content, playing recorded content, performing menu operations, performing guide operations, changing system settings, changing receiving device settings, changing user preferences, changing menu settings, changing guide settings, changing favorites lists, playing particular programs, playing particular content; switching to particular channels, changing source input, changing remote-control device modes, changing parental control settings, changing user credentials, changing television settings, changing auxiliary device settings, changing volume, turning on or off muting, changing closed captioning settings, changing subtitle settings, changing video settings, changing audio settings, changing display mode settings, changing content recording settings, changing future program recording settings, changing alerts, changing home automation settings and changing home security settings.

16. The method of claim 11, further comprising:

if it is determined by the receiving device, in response to receiving the other command, that the remote-control device is currently assigned to a special limited use mode, then the receiving device determining not to execute particular commands received from the remote-control device until a command is received from a different remote-control device that is determined by the receiving device to currently not be in the special limited use mode.

17. The method of claim 11, further comprising:

if it is determined by the receiving device, in response to receiving the other command, that the remote-control device is currently assigned to a special limited use mode, then the receiving device disabling one or more functions of the receiving device until a command is received from a different remote-control device that is determined by the receiving device to currently not be in the special limited use mode.

18. The method of claim 1 wherein the interpreting, by the receiving device, the command received from the remote-control device according to the special mode includes:

determining, by the receiving device, whether the command received from the remote-control device is in a list of commands associated with the special mode;

if it is determined, by the receiving device, that the command received from the remote-control device is in a list of commands associated with the special mode then, instead of executing the received command, the receiving device using the command received from the remote-control device to find a stored special mode process to be performed that is mapped to the command received from the remote-control device; and using, by the receiving device, the stored special mode process as the command interpreted according to the special mode.

19. The method of claim 18 wherein the special mode process to be performed that is mapped to the command received from the remote-control device is a sequence of commands.

20. The method of claim 18 wherein the special mode process to be performed that is mapped to the command received from the remote-control device is to ignore the command received from the remote-control device.

21. A system for providing remote-control special modes, comprising:

at least one controller of a receiving device; and a memory coupled to the at least one controller of the receiving device, the memory having computer-executable instructions stored thereon that, when executed by the at least one controller of the receiving device, cause the at least one controller of the receiving device to:

be able to receive a command to have a remote-control device of the receiving device be in a special mode;

in response to the received command to have a remote-control device of the receiving device be in a special mode, record on the receiving device an association of an identifier of the remote-control device with the special mode; and interpret commands received by the receiving device from the remote-control device based on the association of the identifier of the remote-control device with the special mode.

22. The system of claim 21, wherein the computer-executable instructions, when executed by the at least one controller of the receiving device, further cause the at least one controller of the receiving device to execute commands received by the receiving device from the remote-control device based on the association of the identifier of the remote-control device with the special mode.

23. The system of claim 21, wherein the computer-executable instructions, when executed by the at least one controller of the receiving device, further cause the at least one controller of the receiving device to determine to not execute particular restricted commands received by the receiving device from the remote-control device based on the association of the identifier of the remote-control device with the special mode.

24. A non-transitory computer-readable storage medium having computer executable instructions thereon that, when executed by at least one computer processor, cause the at least one computer processor to:

cause a receiving device to assign a remote-control device of the receiving device to a special mode;

interpret commands received by the receiving device from the remote-control device assigned to the special mode based on an association stored on the receiving device of an identifier of the remote-control device with the special mode; and respond to a command received by the receiving device from the remote-control device assigned to the special mode differently than the same command received by the receiving device from a different remote-control device that is not assigned by the receiving device to the special mode.

25. The non-transitory computer-readable storage medium of claim 24 wherein the computer executable instructions, when executed, cause the at least one computer processor to respond to a command received by the receiving device from the remote-control device assigned to the special mode differently than the same command received by the receiving device from a different remote-control device that is not assigned by the receiving device to the special mode by causing the at least one computer processor to ignore the command received by the receiving device from the remote-control device assigned to the special mode and to not ignore the same command received by the receiving device from the different remote-control device that is not assigned by the receiving device to the special mode.

26. The non-transitory computer-readable storage medium of claim 24 wherein the command received by the receiving device from the remote-control device assigned to the special mode is a command to change to a next channel and the computer executable instructions, when executed, cause the at least one computer processor to respond to the command received by the receiving device from the remote-control device assigned to the special mode differently than the same command received by the receiving device from a different remote-control device that is not assigned by the receiving device to the special mode by causing the at least one computer processor to:

in response to the command received by the receiving device from the remote-control device assigned to the special mode to change to a next channel:

take the receiving device out of a standby mode if the receiving device is in the standby mode; and change a current channel to a music service channel within a list of music service channels even if a current channel of the receiving device is not a music service channel and the next channel is not a music service channel; and in response to a same command to change to a next channel received by the receiving device from the different remote-control device that is not assigned by the receiving device to the special mode, change to the next channel.

27. The non-transitory computer-readable storage medium of claim 24 wherein the computer executable instructions thereon, when executed, further cause the at least one computer processor to:

be able to receive a command from the remote-control device to assign the remote-control device of the receiving device to the special mode; and in response to the command received from the remote-control device to assign the remote-control device of the receiving device to the special mode, cause the receiving device to assign the remote-control device of the receiving device to the special mode by storing the association on the receiving device of the identifier of the remote-control device with the special mode.

* * * * *